United States Patent [19]

Powell et al.

[11] Patent Number: 4,860,717

[45] Date of Patent: Aug. 29, 1989

[54] SELF-LOADING, REMOTELY OPERABLE AND VARIABLE, PORTABLE BALL THROWING APPARATUS AND METHOD

[75] Inventors: Richard Powell; Bert L. Powell, Jr., both of Austin, Tex.

[73] Assignee: Powell/Teeple Enterprises, Inc., Austin, Tex.

[21] Appl. No.: 219,896

[22] Filed: Jul. 14, 1988

Related U.S. Application Data

[63] Continuation of Ser. No. 54,568, May 21, 1987, abandoned.

[51] Int. Cl.[4] ..... F41B 3/04; A63B 69/40

[52] U.S. Cl. ..... 124/7; 124/17; 124/34; 124/36; 124/50; 273/26 D

[58] Field of Search ..... 124/7, 8, 17, 34, 35 R, 124/36, 41 R, 4, 5, 6, 80; 273/26 D

[56] References Cited

U.S. PATENT DOCUMENTS

| | | | |
|---|---|---|---|
| 894,738 | 7/1908 | Hindmarsh | 124/7 |
| 1,203,027 | 10/1916 | McMillan | 124/7 |
| 1,204,645 | 11/1916 | Boardman | 273/26 D X |
| 2,080,958 | 5/1937 | Beasley et al. | 124/7 |
| 2,082,818 | 6/1937 | Atwell | 124/7 X |
| 2,700,379 | 1/1955 | Brigati | 124/7 |
| 3,552,371 | 1/1971 | Kahelin | 124/7 |
| 3,722,494 | 3/1973 | Slevin | 124/7 |
| 3,777,733 | 11/1973 | Mitchell | 124/7 |
| 3,788,297 | 1/1974 | Borst | 124/7 |
| 4,082,076 | 4/1978 | Perry | 124/7 |
| 4,256,303 | 3/1981 | Dobbins | 124/7 X |
| 4,262,648 | 4/1981 | Wegener et al. | 124/6 |
| 4,271,813 | 6/1981 | Rowe | 124/7 |
| 4,552,120 | 11/1985 | Nall et al. | 124/1 |

*Primary Examiner*—Randolph A. Reese
*Assistant Examiner*—John A. Ricci
*Attorney, Agent, or Firm*—Arnold, White & Durkee

[57] ABSTRACT

A self-loading, remotely operable and variable, portable ball thrower. An arm with a hand attached thereto is, in the uncocked position, tensioned by an elastic biasing element, such as surgical tubing, in the forward direction. An individual batter, operator, can, by means of a cocking handle, operate the arm in the rearward direction, pick up a ball from a self-loading trough, and reset the arm in the cocked position. Assuming a natural batter's stance, the batter may then, with his or her foot, release the cocking handle thereby allowing the elastic biasing element to draw, with ever increasing speed, the arm towards the uncocked position. Upon reaching the uncocked position, the ball is released in a fluid throwing manner in a consistent angle towards the batter. The invention enables the batter to raise and lower the pitch in the batting zone by placing the cocking handle in one of a number of adjustment holes so that the batter may practice low or high pitches or different batters of different heights may rapidly adjust the pitch for their needs. Additionally, the device enables the individual batter to throw fly balls, strikes, or grounders. The device is easily disassembled and assembled, is lightweight and portable.

26 Claims, 3 Drawing Sheets

FIG. 7
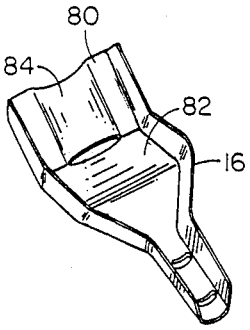
FIG. 6
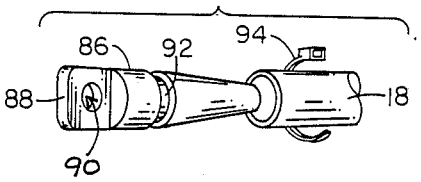
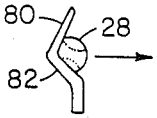
FIG. 6A
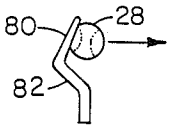
FIG. 6B
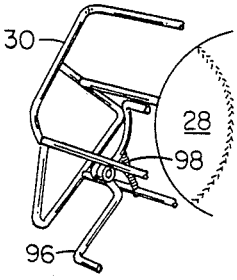
FIG. 8
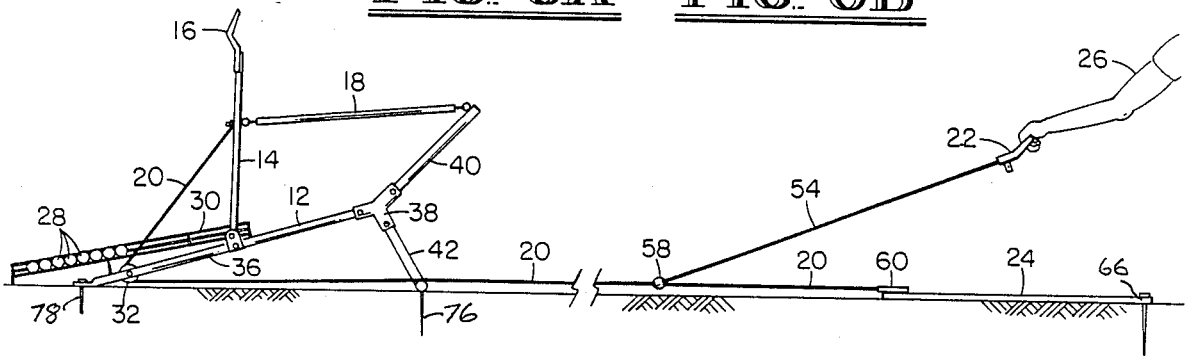
FIG. 9
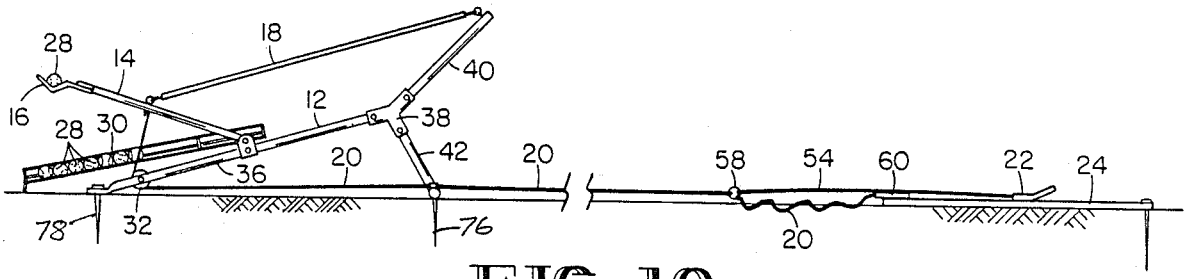
FIG. 10
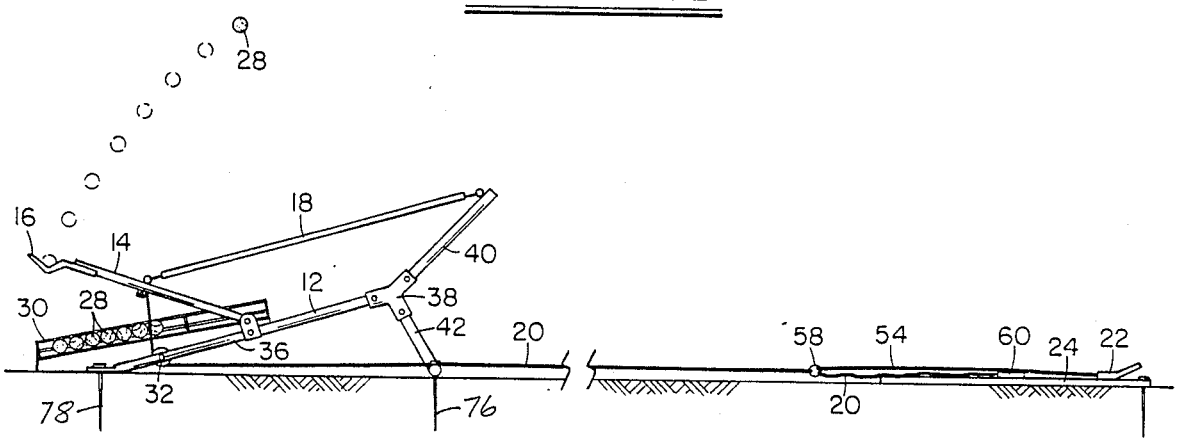
FIG. 11

SELF-LOADING, REMOTELY OPERABLE AND VARIABLE, PORTABLE BALL THROWING APPARATUS AND METHODBACKGROUND OF THE INVENTION

This application is a continuation of application Ser. No. 054,568, filed May 21, 1987, now abandoned.

This invention relates to an improved self-loading, remotely operable and variable, portable ball throwing device.

Both manual and automatically driven ball throwing mechanisms have been known in the art for quite some time. For example, a manual throwing device which holds a ball in a wire loop and "throws" a ball by knocking it out of the wire loop upon impact has been designed. An example of such a device is disclosed in Beasley et al. U.S. Pat. No. 2,080,958 which incorporates the use of a wire loop on a handle which is pulled toward the top of a box and slammed against the box to cause the release of the ball. The operator of this Beasley device must remain behind the box to load the balls into the loop and to release the arms.

Another manually operated pitching machine is disclosed in Rowe U.S. Pat. No. 4,271,813. The Rowe machine is a tripod designed to generally resemble a human being with a spring torsioned arm that is drawn back by the batter to pick up a large softball. The batter then slips the pull string off of the bat as he stands at the plate, the arm is released and the softball is "thrown".

Yet another manually operated throwing device is disclosed in Perry U.S. Pat. No. 4,082,076. This patent discloses a spring actuated throwing device designed to throw one ball, tethered to the ground, again and again. The ability to adjust the pitch up and down in the batter's box is limited and complicated to achieve, if at all. Any adjustments for speeds of pitches is equally difficult to achieve, if at all, and the device is complicated to assemble and position correctly. Also, the arm is limited in its range of motion.

Automatic ball machines, such as Nall et al. U.S. Pat. No. 4,552,120, obviously require the presence of electricity, are typically mechanically complicated and expensive.

A drawback to the electrically powered ball throwers, and especially to the manually operated ball throwers, known in the art, is that, should the batter desire to change the height of the pitch thrown, they require leaving the batter's box and making complicated and intricate changes that require considerable testing before the pitch is successfully changed. As a result, the ability to change the location of the pitch, from pitch to pitch, within the batter's box is non-existant. Further, prior art devices are limited or incapable of altering the velocity of the pitches thrown; the height, either fly balls or ground balls, of the balls thrown; have no reliable self-loading mechanism; and cannot consistently throw a pitch over and over again the same location. Thus, there is a need in the art for providing a ball throwing device which is remotely adjustable and operable; self-loading; capable of alternating pitches, one after the other, up and down, within the batting box; capable of producing high and low velocity pitches; capable of throwing fly and ground balls; and which is simple in design, collapsible and portable.

It, therefore, is an object of this invention to provide an improved remotely operable and variable, self-loading, portable ball throwing device.

SHORT STATEMENT OF THE INVENTION

Accordingly, the ball throwing device of the present invention includes a frame having an arm rotatably mounted thereon. A "hand" means for holding a ball is mounted to the free end of the arm. One or more elastic biasing means, such as surgical tubing, are connected to the arm and to the frame and draw the arm towards the front of the frame. On the opposite side of the arm from the surgical tubing connection is one end of an arm positioning means, such as a nylon cord. The nylon cord is passed over a pulley at the rear of the frame and passes forward and concludes in a hook, or anchoring means, attached to the opposite end of the cord. A rectangularly shaped peg board is designed to receive and retain the anchor attached to the cord in one free end of the board. With the anchor attached, the peg board is drawn back until the arm is drawn back until the arm is drawn to the vertical position. At that point, the peg board is secured to the ground by means of a stake driven through a hole in the rear end of the peg board. Attached between the ends of the positioning cord is a cocking handle. The cocking handle has a peg which conforms to holes drilled into the peg board numbered consecutively from "1" upward starting at the free end of the peg board where the anchor is located.

A removably attachable self-loading trough is attached to the frame and designed so as to admit a ball into the hand when the cocking handle draws the arm past horizontal to its full rearward position. In operation, the cocking handle is grasped, the handle is pulled away from the frame which draws the arm backwards and a ball is loaded into the hand. The operator then places the cocking handle peg into a preselected hole in the peg board. The batter then assumes a natural batting stance and, with his foot, simply lifts the cocking handle slightly causing the peg to be withdrawn from the peg board and the surgical tubing to draw the arm forward in ever increasing speed until the ball is launched towards the batter. Should the batter desire to lower the pitch, he simply places the cocking handle in a number lower than the one first selected. If the batter desires to raise the pitch, he places the cocking handle in the number higher than the one first selected. The same pitch may be thrown again and again and again by simply replacing the cocking handle in the originally selected hole.

BRIEF DESCRIPTION OF THE DRAWINGS

Other objects, features and advantages of the present invention will become more fully apparent from the following detailed description of the preferred embodiment, the appended claims, and the accompanying drawings in which:

FIG. 6 is a plan view of the "hand" of the invention;

FIG. 6A is a side view of the hand with a ball in the "normal" position;

FIG. 6B is a side view of the hand with a ball out of the "normal" position;

FIG. 7 is an exploded view of the connection means utilized to join the elastic biasing means to the frame;

FIG. 8 is a partial view of the operating mechanism of the self-loading trough;

FIG. 9 is a side view illustrating a batter preparing to pull the cocking handle and move the arm from the resting position;

FIG. 10 is a side view showing the invention in the cocked position; and

FIG. 11 is a side view illustrating the position of the anchor and cocking handle for the delivery of a fly ball.

DETAILED DESCRIPTION OF THE PREFERRED EMBODIMENT

Figures 1, 2, 3:
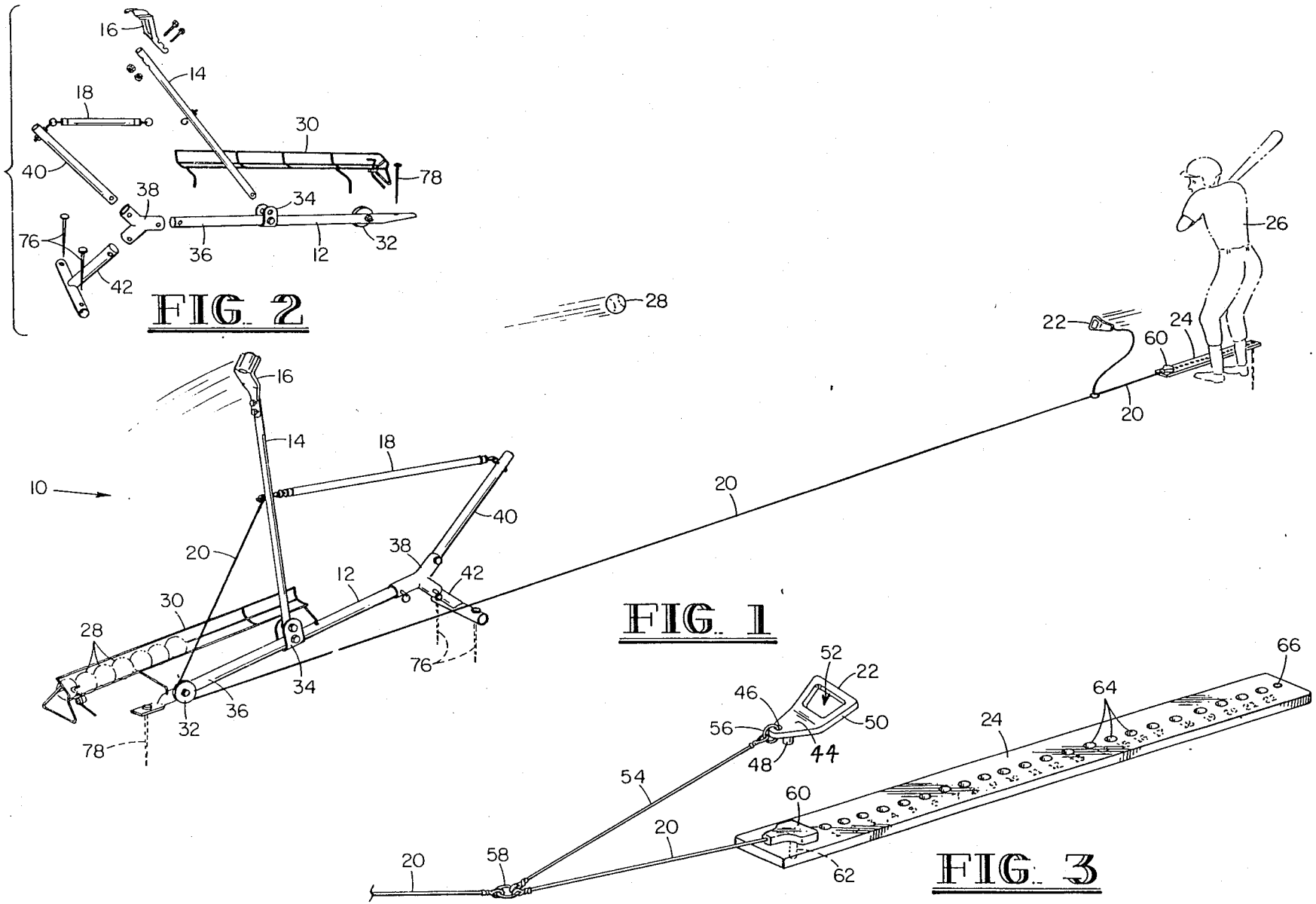
FIG. 1 is a plan view of a preferred embodiment of the ball throwing device of the present invention.
FIG. 2 is a view of the frame portion of the invention partially disassembled.
FIG. 3 is a plan view of the anchor, peg board, and cocking handle of the invention.

The preferred embodiment of the present invention is illustrated by way of example in FIGS. 1–11. With specific reference to FIGS. 1, 2, and 3, a ball thrower 10 includes a frame 12, rotatably attached arm 14, hand 16, and power length 18. FIG. 1 also illustrates arm positioning cord 20, cocking handle 22, and peg board 24. Also shown are batter 26, ball 28, and self-loading trough 30.

Referring to FIG. 2, pulley 32, attached to frame 12, is shown along with rotatable attachment area 34. Also shown as part of frame 12, are main stem section 36; "Y" connection 38 attached to frame 12; power section 40 attached to the upper length of "Y" connection 38; and dead man section 42 attached to the lower arm of "Y" connection 38. FIG. 3 illustrates forward flat section 44 of cocking handle 22, attachment hole 46 in forward flat section 44, downward pointing peg 48, and upwardly sloping handle 50. The hole 52 through which the user may place his fingers to grasp handle 22 is also shown. Handle connecting cord 54 is shown connected by handle connection 56, of any conventional design known in the art, in this case a metal ring. Cord 54 is also connected by positioning cord connection 58 to arm positioning cord 20.

FIG. 3 also illustrates removably attachable anchor 60 which has a peg 62, shown in dotted lines, designed to conform to a large number of adjustment holes 64 as does peg 48. Peg board 24 has stake hole 66 through which any convenient stake (not shown) may be driven in order to secure peg board 24 to the ground.

Figure 4:
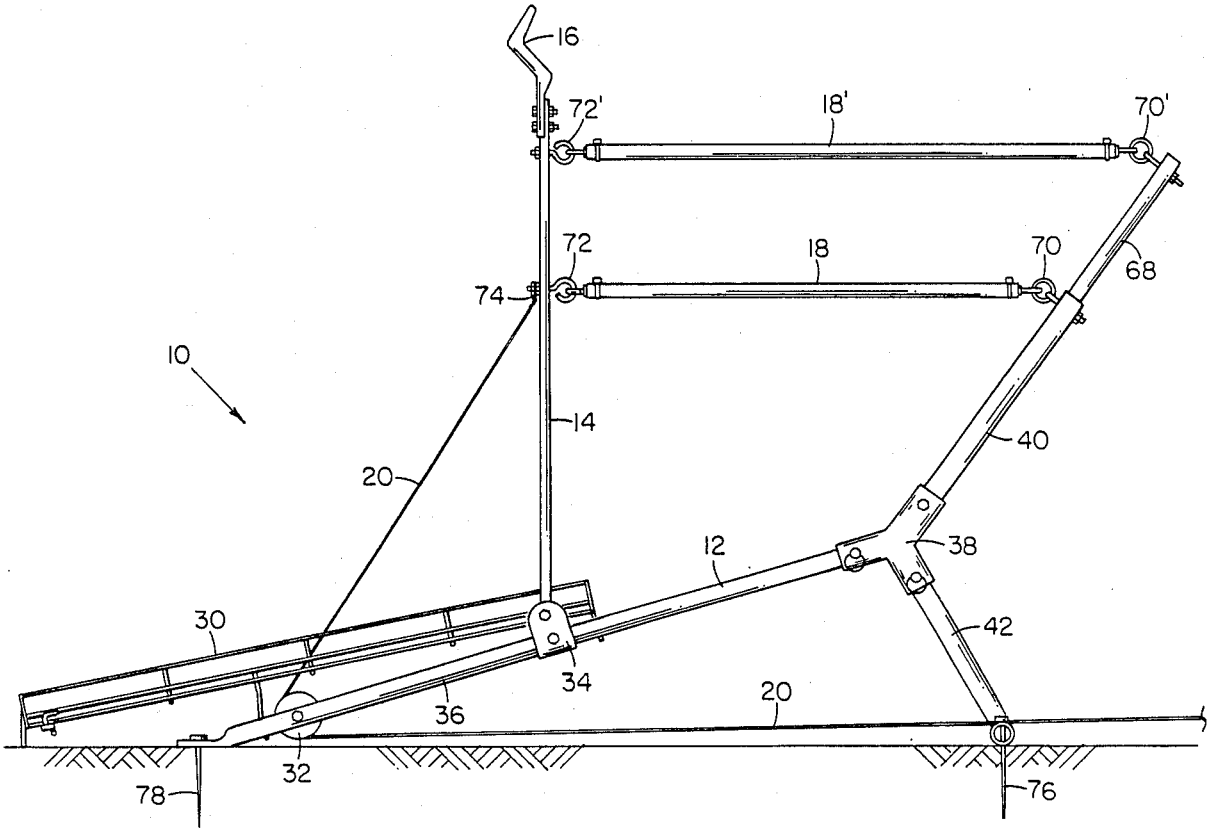
FIG. 4 is a side view of the invention in the uncocked position with self-loading trough attached.

Turning now to FIG. 4, ball thrower 10 is shown in the uncocked position. Also illustrated in FIG. 4 is supplemental power section 68 with additional power length 18'. Further, power section connections 70 and 70' are shown, in this instance consisting of hooks and rings of conventional design known in the art and not described further herein. Arm connections 72 and 72' are similarly disclosed, yet arm connections 72 and 72' have unclosed loops so that power lengths 18 and 18' may be easily removed and attached thereto.

As a result of this configuration, six to eight variations of speed are easily provided. For example, if power length 18 is designated as a length of $\frac{3}{4}''$ O.D. surgical tubing, "A", in the low position and power length 18' is designated as a length of $\frac{5}{8}''$ O.D. surgical tubing, "B", in the high position, the following eight positions 1 to 8, slowest to fastest, are possible:

| | |
|---|---|
| 1. High Position = None<br>Low Position = B | 2. High Position = B<br>Low Position = None |
| 3. High Position = None<br>Low Position = A | 4. High Position = A<br>Low Position = None |
| 5. High Position = B<br>Low Position = B | 6. High Position = B<br>Low Position = A |
| 7. High Position = A<br>Low Position = B | 8. High Position = A<br>Low Position = A |

This speed range requires two of each type power length. Six speeds are available if only one type of each power length is used thereby excluding speeds 5 and 8 set forth above.

Figure 5:
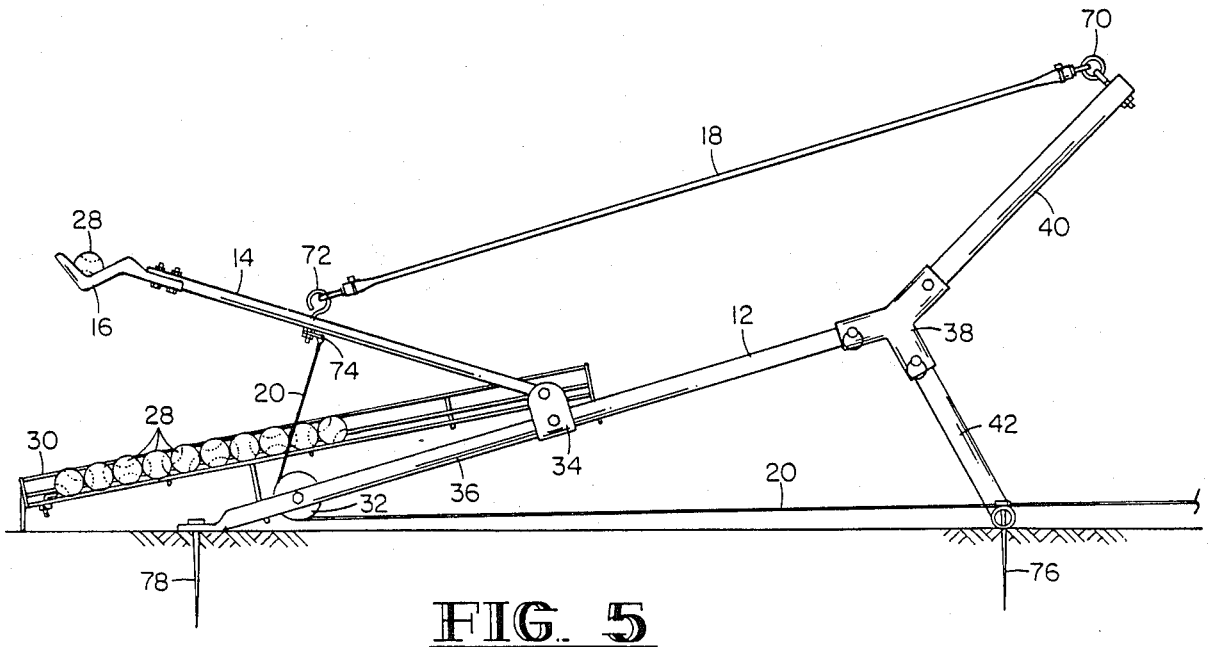
FIG. 5 is a side view of the invention in the cocked position, and self-loading trough with balls attached.

It should also be pointed out that a most important improvement of this invention, as illustrated in FIGS. 4 and 5 for example, is the fact that dead man section 42 elevates device 10 above the ground horizontal. This elevation significantly enhances the range of arm 14 which, in prior art devices, can not dip below a horizontal plane parallel to the ground. As a result, more range, power and action is provided for in arm 14.

Additionally, FIGS. 4 and 5, illustrate another important feature of invention 10 wherein power length(s) 18 (and 18') have one end secured at 70 (70') in an elevated position that "points" the power lengths directly at the target area somewhat above the batter's box. As a result, arm 14 is pulled forcefully directly towards the target.

Also shown is arm positioning cord attachment 74 attached to the back of arm 14; dead man stake 76; and rear end stake 78.

FIG. 5 shows ball thrower 10 in the cocked position with ball 28 in cup 16 ready to be thrown. FIG. 5 does not show supplemental power section 68 attached, although it is obvious that it may be used in addition to the primary power section 40. Both FIG. 4 and FIG. 5 show that arm positioning cord 20 passes over the top of the foot of dead man section 42 on its way to the rear of frame 12 where it passes around pulley 32 and is connected to arm 14 at arm positioning cord attachment 74.

FIGS. 6, 7, and 8 are close ups of some particulars of the ball thrower 10. FIG. 6 illustrates hand 16. As shown, for example in FIG. 4, top section 80 of hand 16 is flat and is bent in an approximately 90 degree angle from the rear section 82. Top section 80 has central groove 84 into which some portion of ball 28 will rest. Ball 28 should rest and be supported partially by rear section 82 and top section 80 as shown in FIG. 6-A. Nonetheless, because of the groove 84 and flat top section 80, should the ball not be held as in FIG. 6-A, but be somewhere else in hand 16, as shown in FIG. 6-B, the ball 28 will still be released at the same angle and reach the same position at the batter's box as the previous pitch, as illustrated by the directional arrows. Hand 16 may also be rotatably connected to arm 14 by means readily known in the art, but not shown. To function properly, hand 16 should sit at an angle of approximately 135° from arm 14. With a rotatable hand 16, the hand can be rotated forwards a few degrees for faster speeds and backwards a few degrees for slower speeds. This ensures delivery of ball 28 exactly on target.

FIG. 7 illustrates power length 18 and tapered connector 86. Tapered connector 86 has an integral flattened section 88 through which connection hole 90 is drilled. Restraining groove 92 is formed in the body of tapered connector 86 so that when tapered connector 86 is inserted into power length 18, restraining pincher 94, of ordinary design known in the art, can be located over restraining groove 92 and drawn tight so that power length 18 is firmly held within restraining groove 92 and tapered connector 86 is securely attached to power length 18 thereby. The tapered shape of connector 86 reduces wear and tear on surgical tubing 18 as it stretches over the connector.

FIG. 8 illustrates the lower rear section of self-loading trough 30 with ball 28 in place. As shown in FIG. 4, for example, trough 30 is removably attachable to frame 12 in the area of rotatable attachment 34 so that the front end of trough 30 is elevated above the ground and that balls 28 roll, by force of gravity, to the rear section illustrated in FIG. 8. The rear section of trough 30 extends beyond the rear end of frame 12 as illustrated, once again, in FIGS. 4 and 5 for example, and has a loading lever 96 constantly biased by spring 98 in the upward position so that loading lever 96 prevents balls 28 from exiting trough 30 at the rear. Trough 30 and arm 14 and handle 16 are designed so that when arm 14 is drawn backwards, hand 16 pushes lever 96 down and allows ball 28 to roll into hand 16. FIG. 8 shows lever 96 in the down position thereby allowing ball 28 to roll free of trough 30. As arm 14 is allowed to move forward, when cocking handle 22 is placed in the selected adjustment hole 64 of peg board 24, loading lever 96 will be raised by spring 98 so that additional balls 28 are retained within trough 30.

In operation, set up of ball thrower 10 is simply accomplished. To begin with, peg board 24 is located in the preferred area, batter's box, selected by batter 26 by means of driving a stake through stake hole 66. Removably attachable anchor 60 is then attached to peg board 64 at the free end of peg board 24. The batter 26 then walks to ball thrower 10, grabs frame 12 and walks backwards from the batter's box with frame 12 until arm 14 has been pulled to an upright position approximately perpendicular to the ground. Ball thrower 10 is designed so that power length 18, when arm 14 is in the perpendicular position, will be stretched to approximately 100% of its original length. As a result, when in this "uncocked" position as shown in FIG. 9 for example, power length 18 will be stretched and pulling on arm 14.

Once frame 12 is correctly positioned, the device is rested on the ground and rear end stake 78 driven into the ground to secure ball thrower 10 in the proper position. Batter 26 then moves to the front of frame 12 and drives dead man stakes 76 and returns to the batter's box.

As illustrated in FIGS. 9 and 10, batter 26 then grasps cocking handle 22, and by means of handle connecting cord 54, pulls arm positioning cord 20 towards the batter's box. Because arm positioning cord 20 is attached to arm 14 at attachment 74, arm 14 is drawn backwards and power length 18, and 18' if attached, is stretched further. Batter 26 continues to pull cocking handle 22 until hand 16 depresses loading lever 96 and ball 28 is released into hand 16. The batter then eases arm 14 forward and places peg 48 in any one of the numbered adjustment holes 64 in peg board 24. The ball thrower 10 is now in the "cocked" position as illustrated in FIG. 10. At this point, batter 26 assumes a normal batting stance. Because cocking handle 22 has upwardly sloping handle 50, as shown in FIGS. 10 and 11 for instance, batter 26 then can use his foot to gently lift cocking handle 22 just enough to release peg 48 from adjustment hole 64. At this moment, power length 18 begins to draw, with ever increasing power, arm 14 rapidly forward towards the batter. Upon reaching the uncocked position previously selected by batter 26, arm positioning cord 20 stops the forward motion of arm 14 and the ball 28 is thrown forward towards the batter. It should be pointed out that arm 14 is constructed of any light weight resilient and strong material preferably with some small degree of flexibility so that there is not the abrupt impact stop of previous devices but so that it duplicates the natural fluid throwing motion, as close as possible, of the human arm.

As previously disclosed, the inventor has determined that balls may be thrown in a wide variety of speeds by the simple means of using power lengths 18 of different elasticities. A piece of surgical tubing, for instance, with very high elasticity would throw a ball slowly and softly. A less elastic piece of surgical tubing will obviously increase the speed. By means of the additional of supplemental power section 68, a variety of speeds may be obtained from slow to fast by combining weak power lengths with stronger ones and so forth. This inventor believes that speeds approximating 100 m.p.h. are attainable through this device.

Should the batter desire to throw fly balls, as illustrated in FIG. 11, anchor 60 is simply moved forward along peg board 24 so that the uncocked position is in a more rearward direction. As a result, when cocking handle 22 is released the arm comes to rest more quickly and the ball is thrown in a more upward direction. Ground balls may also be thrown by reversing this process. As a result of this simple means, balls may be thrown across the whole range, from fly balls, to batting, to ground balls, with a single device.

It should be emphasized that the batter has control over the area where the ball is to be pitched to a degree heretofor unknown. That is, by the simple means of placing cocking handle 22 in a higher numbered adjustment hole 64, the ball will be raised in the strike zone. By placing cocking handle 22 in a lower numbered adjustment hole 64, than the previous pitch, the ball will be lowered in the strike zone. The benefits of this are obvious in that not only can a single batter practice pitches in a wide variety of locations, but batters of different heights may be easily accommodated one after another without complicated removal and reassembly of the device as required by prior art machines.

An added and extremely important advantage of this device is the fact, as shown in FIG. 2, that it may be disassembled, partially or totally, into a small number of pieces for transportation. The device is not bulky, is lightweight and easy to transport, assemble, set up, and utilize.

Further, a single operator may utilize the invention or, a coach may control the delivery of the pitch to the batter by simply holding onto cocking handle 22, not placing it in an adjustment hole 64, and releasing cocking handle 22 when the coach and the batter are ready.

Another advantage of ball thrower 10 over prior art inventions is hand 16. Prior art devices were unable to ensure that the ball 28 would leave their devices at consistently the same angle. By combination of flat top section 80 with an approximately 90 degree rear angle section 82, and central groove 84, ball 28 is consistently positioned for throwing. Even if ball 28 is not located in the crux of hand 16, as shown in FIG. 6-B, because of its construction, hand 16 must release the ball at the same angle time and time again. Prior art devices cause the angle of delivery to differ from throw to throw.

While the ball thrower of the present invention has been disclosed in connection with manual operation, it should be appreciated that the device is capable of attachment to a small electrically driven winch (not shown) that would operate arm 14 upon demand of batter 26 in much the same way as the manual cocking handle 22 operates. Further, the present invention provides an improved ball thrower which can be easily manipulated in order, for example, to vary the location of pitches to an individual batter; to accommodate for different height batters; to vary the velocity of thrown pitches; as well as enabling the batter to throw fly balls, strikes or grounders. The ball thrower is simple and reliable, easy to assemble and may be remotely operated by a single individual, the batter. Thus, the ball thrower of the present invention has a variety of important advantages over the prior art.

While the present invention has been disclosed in connection with the preferred embodiment thereof, it should be understood that there may by other embodiments which fall within the spirit and scope of the invention as defined by the following claims:

What is claimed is:

1. A ball throwing device comprising:

A. a frame;

B. an arm rotatably mounted to said frame;

C. a hand means for holding a ball, mounted to one end of said arm;

D. an elastic biasing means connected to said arm and to said frame;

E. an arm positioning means having two ends;

F. one end of said arm positioning means connected to said arm;

G. a removably attachable anchor attached to the other end of said arm positioning means;

H. a means for adjusting the height of a thrown ball at a batter's box with one free end, and one end anchored to the ground;

I. said removably attachable anchor removably attached to said free end of said height adjusting means; and J. a cocking handle attached at one end of said arm positioning means between said ends of said positioning means and removably attachable to said height adjusting means, so that when said cocking handle is released, said arm is pulled forward by said elastic biasing means and said ball is thrown towards said batter's box.

2. The ball throwing device of claim 1 wherein said frame comprises:

A. a main stem section;

B. a lower rear end, secured to the ground, of said main stem;

C. an arm positioning pulley means, located forward of said lower rear end around which said arm positioning means passes;

D. a means for rotatably mounting said arm to said frame located in the mid-point of said main stem;

E. a "Y" connection means secured to an upper forward end of said main stem;

F. a power section attached to the upper portion of said "Y" connection, to which one end of said elastic biasing means is attached; and G. a dead man section attached to the lower portion of said "Y" connection, secureable to the ground, which receives the shock of said arm when released and which prevents said frame from moving perpendicularly to said arm.

3. The ball throwing device of claim 2 wherein said hand means comprises:

A. an angled three sided ball receiving means;

B. a central groove in the center side of said ball receiving means into which some portion of said ball protrudes so that said central groove guides said ball causing said ball to leave said receiving means consistently straight; and C. other than said groove, said center side is flat so that wherever said ball is in said central groove, said ball will be released at the same angle towards said batter's box.

4. The ball throwing device of claim 3 wherein said elastic biasing means further comprises:

A. a plurality of interchangeable elastic biasing means of a variety of elasticities so that fast and slow balls may be thrown by proper selection of said interchangeable elastic biasing means; and B. said elastic biasing means is stretched at least 100% of its length when in a resting position so that when said arm is released after being pulled backward by said arm positioning means, said elastic biasing means continues to pull/retract all the time said ball is being thrown and a tensioned position is always maintained even at rest.

5. The ball throwing device of claim 4 wherein said height adjusting means further comprises:

A. a rectangularly shaped essentially flat peg board;

B. a hole in one end through which said board is secured to the ground;

C. a hole in the opposite, free end, to which said anchor is removably attached; and D. a plurality of intervening height adjustment holes consecutively numbered beginning at said free end so that positioning of said cocking handle in a lower numbered adjustment hole lowers said thrown ball relative to a previously thrown ball and positioning said cocking handle in a higher numbered adjustment hole raises said thrown ball relative to said previously thrown ball.

6. The ball throwing device of claim 5 wherein said cocking handle further comprises:

A. a forward flat section with a hole therethrough to receive one end of a connecting means, the other end of said connecting means which is attached between said ends of said positioning means;

B. a downward pointing peg on said flat section conformed to fit into said plurality of holes in said peg board; and C. an upwardly sloping handle attached to said flat section so that when said peg is placed in said hole said handle is positioned above the flat surface of said peg board thus enabling a batter in said batter's box to release said cocking handle with said batter's foot.

7. The ball throwing device of claim 1 further comprising self-loading means for automatically loading said ball throwing device when said hand means is drawn backward to a cocked position by said cocking handle.

8. The ball throwing device of claim 7 wherein said self-loading means comprises:

A. a trough for holding a plurality of balls removably attachable at a forward end to said main stem at the mid section of said main stem so that said trough is raised above the ground at said midsection;

B. a rearward end of said trough that extends beyond said lower rear end of said main stem and rests on the ground; and C. a loading lever that, when raised, prevents balls from exiting said trough, spring biased in said raised position.

9. A ball throwing device comprising:

A. a frame with a main stem section;

B. a lower rear end, secured to the ground, of said main stem;

C. an arm rotatably mounted to said frame;

D. a hand means for holding a ball mounted to one end of said arm;

E. an elastic biasing means connected to said arm and to said frame;

F. an arm positioning means having two ends;

G. one end of said arm positioning means connected to said arm;

H. a removably attachable anchor attached to the other end of said arm positioning means;

I. a means for adjusting the height of a thrown ball at a batter's box with one free end, and one end anchored to the ground;

J. said removably attachable anchor removably attached to said free end of said height adjusting means;

K. a cocking handle attached at one end to said arm positioning means, between said ends of said positioning means, and removably attachable to said height adjusting means, so that when said cocking handle is released, said arm is pulled forward by said elastic biasing means and said ball is thrown towards said batter's box;

L. an arm positioning pulley means, located forward of said lower rear end around which said arm positioning means passes;

M. a means for rotatably mounting said arm to said frame located in the mid-point of said main stem;

N. a "Y " connection secured to an upper forward end of said main stem;

O. a power section attached to the upper portion of said "Y" connection, to which one end of said elastic biasing means is attached;

P. a dead man section attached to the lower portion of said "Y" connection, secureable to the ground, which receives the shock of said arm when released and which prevents said frame from moving perpendicularly to said arm;

Q. said hand means having an angles three sided ball receiving means;

R. a central groove in the center side of said ball receiving means into which some portion of said ball protrudes so that said central groove guides said ball causing said ball to leave said receiving means consistently straight;

S. other than said groove, said center side is flat so that wherever said ball is in said central groove, said ball will be released at the same angle towards said batter's box;

T. a plurality of interchangeable elastic biasing means of a variety of elasticities so that fast and slow balls may be thrown by proper selection of said interchangeable elastic biasing means;

U. said elastic biasing means is stretched at least 100% of its length when in a resting position so that when said arm is released after being pulled backward by said arm positioning means, said elastic biasing means continues to pull/retract all the time said ball is being thrown and a tensioned position is always maintained even at rest;

V. said height adjusting means formed in a rectangularly shaped essentially flat peg board;

W. a hole in one end of said peg board through which said board is secured to the ground;

X. a hole in the opposite free end of said peg board to which said anchor is removably attached;

Y. a plurality of intervening height adjustment holes consecutively numbered beginning at said free end so that positioning of said cocking handle in a lower numbered adjustment hole lowers said thrown ball relative to a previously thrown ball and positioning said cocking handle in a higher numbered adjustment hole raises said thrown ball relative to said previously thrown ball;

Z. said cocking handle with a forward flat section with a hole therethrough to receive one end of a connecting means, the other end of said connecting means which is attached between said ends of said positioning means;

AA. a downward pointing peg on said flat section conformed to fit into said plurality of holes in said peg board;

BB. an upwardly sloping handle attached to said flat section so that when said peg is placed in said hole said handle is positioned above the flat surface of said peg board thus enabling a batter in said batter's box to release said cocking handle with said batter's foot; and CC. a self-loading means for automatically loading said ball throwing device when said hand means is drawn backward to a cocked position by said cocking handle.

10. The ball throwing device of claim 9 wherein said self-loading means comprises:

A. a trough for holding a plurality of balls removably attachable at a forward end to said main stem, at the mid section of said main stem, so that said trough is raised above the ground at said midsection;

B. a rearward end of said trough that extends beyond said lower rear end of said main stem and rests on the ground; and C. a loading lever that prevents balls from exiting said trough when raised and is spring biased in said raised position, and which allows said balls to exit when depressed and which is depressed by said hand when in said cocked position.

11. A method for throwing a ball comprising the steps of:

A. constructing a frame;

B. rotatably mounting an arm to said frame;

C. mounting a hand means for holding a ball to the free end of said arm;

D. connecting an elastic biasing means to said arm and to said frame;

E. connecting one end of an arm positioning means to said arm;

F. attaching a removably attachable anchor to the other end of said arm positioning means;

G. providing a means for adjusting the height of a thrown ball at a batter's box, with one free end and one end anchored to the ground;

H. removably attaching said removably attachable anchor to said free end of said height adjusting means; and I. attaching a cocking handle at one end to said arm positioning means, between said ends of said positioning means, and removably attaching said handle to said height adjusting means, so that when said cocking handle is released, said arm is pulled forward by said elastic biasing means and said ball is thrown towards said batter's box.

12. The method for throwing a ball of claim 11 wherein construction a frame comprises the steps of:

A. providing a main stem section;

B. providing a lower rear end of said main stem, secured to the ground;

C. locating an arm positioning pulley means forward of said lower rear end around which said arm positioning means passes;

D. constructing a means for rotatably mounting said arm to said frame and locating said mounting means in the mid-point of said main stem;

E. securing a "Y" connection means to an upper forward end of said main stem;

F. attaching a power section to the upper portion of said "Y" connection, to which one end of said elastic biasing means is attached; and G. attaching a dead man section to the lower portion of said "Y" connection, secureable to the ground, which receives the shock of said arm when released and which prevents said frame from moving perpendicularly to said arm.

13. The method of throwing a ball of claim 12 wherein mounting a hand means comprises the steps of:

A. construction an angles three sided ball receiving means;

B. providing a central groove in the center side of said ball receiving means into which some portion of said ball protrudes so that said central groove guides said ball causing said ball to leave said receiving means consistently straight;

C. other than said groove, constructing said center side flat so that wherever said ball is in said central groove, said ball will be released at the same angle towards said batter's box; and D. attaching said ball receiving means to the free end of said arm method of throwing a ball.

14. The method of throwing a ball of claim 13 comprising the further steps of:

A. providing a plurality of interchangeable elastic biasing means of a variety of elasticities so that fast and slow balls may be thrown by proper selection of said interchangeable elastic biasing means; and B. stretching said elastic biasing means at least 100% of its length when in a resting position so that when said arm is released after being pulled backward by said arm positioning means, said elastic biasing means continues to pull/retract all the time said ball is being thrown and a tensioned position is always maintained even at rest.

15. The method of throwing a ball of claim 14 wherein providing said height adjusting means comprises the steps of:

A. constructing a rectangularly shaped essentially flat peg board;

B. providing a hole in one end of said peg board through which said board is secured to the ground;

C. providing a hole in the opposite, free end, of said peg board to which said anchor is removably attached; and D. constructing a plurality of intervening height adjustment holes consecutively numbered beginning at said free end so that positioning of said cocking handle in a lower numbered adjustment hole lowers said thrown ball relative to a previously thrown ball and positioning said cocking handle in a higher numbered adjustment hole raises said thrown ball relative to said previously thrown ball.

16. The method of throwing a ball of claim 15 wherein attaching said cocking handle further comprises the steps of:

A. constructing a forward flat section with a hole therethrough so as to receive one end of a connecting means, the other end of said connecting means which is attached between said ends of said positioning means;

B. providing a downward pointing peg on said flat section conformed to fit into said plurality of holes in said peg board; and C. attaching an upwardly sloping handle to said flat section so that when said peg is placed/attached in said hole said handle is positioned above the flat surface of said peg board thus enabling a batter in said batter's box to release said cocking handle with said batter's foot.

17. The method of throwing a ball of claim 11 further comprising the step of attaching a self-loading means for automatically loading said ball throwing device when said hand means is drawn backward to a cocked position by said cocking handle.

18. The method of throwing a ball of claim 17 wherein attaching said self-loading means comprises the steps of:

A. removably attaching a trough for holding a plurality of balls at a forward end to said main stem at the mid section of said main stem so that said trough is raised above the ground at said midsection;

B. extending a rearward end of said trough beyond said lower rear end of said main stem and resting said end on the ground; and C. providing a loading lever, spring biased in the raised position, that, when raised, prevents balls from exiting said trough which allows said balls to exit when depressed and which is depressed by said hand when in said cocked position.

19. A method for throwing a ball comprising the steps of:

A. providing a frame with a main stem section;

B. securing a lower rear end to the ground of said main stem;

C. rotatably mounting an arm to said frame;

D. mounting a hand means, for holding a ball, to one end of said arm;

E. connecting an elastic biasing means to said arm and to said frame;

F. connecting one end of an arm positioning means to said arm;

G. attaching a removably attachable anchor to the other end of said arm positioning means;

H. providing a means for adjusting the height of a thrown ball at a batter's box with one free end and one end anchored to the ground;

I. removably attaching said removably attachable anchor to said free end of said height adjusting means;

J. attaching said cocking handle at one end to said arm positioning means, between said ends of said positioning means, and removably attaching said handle to said height adjusting means, so that when said cocking handle is released, said arm is pulled forward by said elastic biasing means and said ball is thrown towards said batter's box;

K. locating an arm positioning pulley means forward of said lower rear end around which said arm positioning means passes;

L. constructing a means for rotatably mounting said arm to said frame and locating said mounting means in the mid-point of said main stem;

M. securing a "Y" connection means to an upper forward end of said main stem;

N. attaching a power section to the upper portion of said "Y" connection, to which one end of said elastic biasing means is attached;

O. attaching a dead man section to the lower portion of said "Y" connection, secureable to the ground, which receives the shock of said arm when released and which prevents said frame from moving perpendicularly to said arm;

P. providing said hand means with an angled three sided receiving means;

Q. constructing a central groove in the center side of said ball receiving means into which some portion of said ball protrudes so that said central groove guides said ball causing said ball to leave said receiving means consistently straight;

R. flattening said center side, other than said groove, is flat so that wherever said ball is in said central groove, said ball will be released at the same angle towards said batter's box;

S. providing a plurality of interchangeable elastic biasing means of a variety of elasticities so that fast and slow balls may be thrown by proper selection of said interchangeable elastic biasing means;

T. providing that said elastic biasing means is stretched at least 100% of its length when in a resting position so that when said arm is released after being pulled backward by said arm positioning means, said elastic biasing means continues to pull/retract all the time said ball is being thrown and a tensioned position is always maintained even at rest;

U. constructing said height adjusting means in the form of a rectangularly shaped essentially flat peg board;

V. providing a hole in one end of said peg board through which said board is secured to the ground;

W. constructing a hole in the opposite free end of said peg board to which said anchor is removably attached;

X. providing a plurality of intervening height adjustment holes consecutively numbered beginning at said free end so that positioning of said cocking handle in a lower numbered adjustment hole lowers said thrown ball relative to a previously thrown ball and positioning said cocking handle in a higher numbered adjustment hole raises said thrown ball relative to said previously thrown ball;

Y. constructing said cocking handle with a forward flat section with a hole therethrough to receive one end of a connecting means, the other end of said connecting means which is attached between said ends of said positioning means;

Z. providing a downward pointing peg on said flat section conformed to fit into said plurality of adjustment holes in said peg board;

AA. constructing an upwardly sloping handle attached to said flat section so that when said peg is placed in said hole said handle is positioned above the flat surface of said peg board thus enabling a batter in said batter's box to release said cocking handle with said batter's foot; and BB. providing a self-loading means for automatically loading said ball throwing device when said hand means is drawn backward to a cocked position by said cocking handle.

20. The method for throwing a ball of claim 19 wherein providing said self-loading means comprises the steps of:

A. constructing a trough for holding a plurality of balls removably attachable at a forward end to said main stem, at the mid section of said main stem, so that said trough is raised above the ground at said midsection;

B. constructing a rearward end of said trough that extends beyond said lower rear end of said main stem and rests on the ground; and C. providing a loading lever that prevents balls from exiting said trough when raised and is spring biased in said raised position, and which allows said balls to exit when depressed and which is depressed by said hand in said cocked position.

21. A ball throwing device comprising:

(a) a frame;

(b) an arm rotatably mounted to said frame for releasably supporting the ball;

(c) an elastic biasing means connected to said arm and to said frame;

(d) an arm positioning means having two ends;

(e) one end of said arm positioning means connected to said arm;

(f) an anchor attached to the other end of said arm positioning means;

(g) a means anchored to the ground for adjusting the height of the thrown ball;

(h) said anchor removably attached to said height adjusting means; and (i) cocking handle attached at one end to said arm positioning means between said ends of said positioning means, so that when said cocking handle is released, said arm is pulled forward by said elastic biasing means and said ball is thrown.

22. The ball throwing device of claim 21 wherein said arm includes a hand portion having a central groove between a pair of spaced, top section finger surfaces, said finger surfaces releasably supporting the ball during the throwing operation.

23. A ball throwing device comprising:

(a) a frame;

(b) an arm rotatably mounted to said frame and adapted for releasably supporting a ball to be thrown;

(c) a biasing means connected to said arm and to said frame to normally bias said arm in a forward direction;

(d) an arm positioning means having two ends, one end of said positioning means connected to said arm;

(e) a retaining means adapted for being anchored to the ground, said retaining means attached to the other end of said positioning means; and (f) a cocking handle attached to said arm positioning means between the ends of the positioning means, said handle cooperating with the positioning means upon operation of the device to pull the arm in a rearward direction so that when said cocking handle is released, said arm is pulled forward by said biasing means and said ball is thrown, yet said cocking handle remains near its original position.

24. A ball throwing device comprising:

(a) a frame;

(b) an arm rotatably mounted to said frame and adapted for releasably supporting a ball to be thrown;

(c) a biasing means connected to said arm and to said frame to normally bias said arm in a forward direction;

(d) an arm positioning means having two ends, one end of said positioning means connected to said arm;

(e) means attached to the other end of said arm positioning means for anchoring said other end to the ground; and (g) a cocking handle attached to said arm positioning means between the ends of the positioning means, said handle cooperating with the positioning means upon operation of the device to pull the arm in a rearward direction so that when said cocking handle is released, said arm is pulled forward by said biasing means and said ball is thrown, yet said cocking handle remains near its original position.

25. The ball throwing device of claim 24 wherein said arm includes a hand portion having a pair of spaced, top section finger surfaces for releasably supporting the ball during the throwing operation.

26. A method for throwing a ball comprising the steps of:

(a) constructing a frame;

(b) rotatably mounting an arm to said frame for releasably supporting the ball;

(c) connecting a biasing means to said arm and to said frame;

(d) connecting one end of an arm positioning means to said arm;

(e) providing a means for adjusting the height of the thrown ball;

(f) anchoring said adjusting means to the ground;

(g) attaching the second end of said arm positioning means to said height adjusting means; and (h) attaching a cocking handle at one end to said arm positioning means between said ends of said positioning means and in close proximity to said adjusting means, so that when said cocking handle is pulled and then released, said arm is pulled forward by said elastic biasing means and said ball is thrown, yet said cocking handle remains in close proximity to said adjusting means.

* * * * *

UNITED STATES PATENT AND TRADEMARK OFFICE

CERTIFICATE OF CORRECTION

PATENT NO. : 4,860,717

DATED : August 29, 1989

INVENTOR(S) : Powell et al.

It is certified that error appears in the above—identified patent and that said Letters Patent is hereby corrected as shown below:

Claim 1.J, column 7, line 40 delete the word "of" and insert the word --to--.

Claim 9.Q, column 9, line 47 delete the word "angles" and insert the word --angled--.

Claim 13.A, column 11, line 28 delete the word "construction" and insert the word --constructing--.

Claim 13.A, column 11, line 28 delete the word "angles" and insert the word --angled--.

Claim 21(i), column 14, line 39 insert the word --a-- before the word "cocking".

Claim 24, column 15, line 17, delete the letter "(g)" and insert the letter --(f)--.

Signed and Sealed this

Twenty-first Day of August, 1990

*Attest:*

HARRY F. MANBECK, JR.

*Attesting Officer*

*Commissioner of Patents and Trademarks*